US006361659B1

(12) United States Patent
Yang

(10) Patent No.: US 6,361,659 B1
(45) Date of Patent: Mar. 26, 2002

(54) PULP MOLD AND MOLDING MEANS FOR MANUFACTURING THE SAME

(76) Inventor: Chun-Tse Yang, 10, Alley 1, Lane 3, Wen-Chien Road, Niao-Sung Hsiang, Kaohsiung County (TW)

( * ) Notice: Subject to any disclaimer, the term of this patent is extended or adjusted under 35 U.S.C. 154(b) by 0 days.

(21) Appl. No.: 09/179,207

(22) Filed: Oct. 27, 1998

Related U.S. Application Data

(63) Continuation-in-part of application No. 08/673,080, filed on Jul. 2, 1996, now Pat. No. 5,826,726.

(30) Foreign Application Priority Data

May 11, 1998 (CN) ..... 84113919 A

(51) Int. Cl.[7] ..... D21J 7/00

(52) U.S. Cl. ..... 162/382; 162/388; 162/411; 162/416; 249/119

(58) Field of Search ..... 162/388, 387, 162/382, 410–416, 218, 219, 228–231; 425/40, 125, 35, 110, 129.1, 32, 831.85; 206/586, 594, 593, 52.1, 523, 585; 249/117, 119, 113; 229/406, 407

(56) References Cited

U.S. PATENT DOCUMENTS

| | | | | |
|---|---|---|---|---|
| 1,929,918 A | | 10/1933 | Dreyer et al. | 206/591 |
| 1,958,050 A | | 5/1934 | Koppelman | 206/594 |
| 2,863,595 A | | 12/1958 | Emery | 206/592 |
| 2,874,826 A | | 2/1959 | Matthews et al. | 206/591 |
| 3,067,470 A | * | 12/1962 | Stickney et al. | 162/411 |
| 3,095,970 A | | 7/1963 | Gaulke | 206/586 |
| 3,101,166 A | | 8/1963 | Antwerpen | 206/591 |
| 3,231,454 A | | 1/1966 | Williams | 206/594 |
| 3,325,349 A | * | 6/1967 | Reifers | 162/411 |
| 3,362,609 A | | 1/1968 | Freedy | 206/592 |
| 3,553,079 A | * | 1/1971 | Hornbostel, Jr. | 162/411 |
| 5,769,233 A | * | 6/1998 | Fredriks | 206/523 |

FOREIGN PATENT DOCUMENTS

| | | |
|---|---|---|
| EP | 0844196 | 5/1998 |
| WO | 93016940 | 9/1993 |
| WO | 9406704 | 3/1994 |
| WO | 9425369 | 11/1994 |

* cited by examiner

*Primary Examiner*—Jose Fortuna
(74) *Attorney, Agent, or Firm*—Ladas & Parry

(57) ABSTRACT

The pulp mold of the invention comprises a plurality of successive pulp mold units. Each unit comprises a plurality of higher and lower surfaces such that the pulp mold has a plurality of corrugated surfaces to provide a plurality of cushions and to simulate the deformation and spring recovery effect for performing positioning and cushioning. The pulp mold of the invention can adjust the number of pulp mold unit according to the weight and size of the article. The molding unit means of the invention can be constructed to be suitable for various articles. When the articles are no longer manufactured, the molding unit means can be re-constructed to be suitably used on other products.

6 Claims, 11 Drawing Sheets

PULP MOLD AND MOLDING MEANS FOR MANUFACTURING THE SAME

This application is a continuation in part of U.S. Ser. No. 08/673,080 filed on Jul. 2, 1996 now U.S. Pat. No. 5,826, 726.

BACKGROUND OF THE INVENTION (I) Field of the Invention

The present invention relates to pulp mold technology for packaging articles and more specifically to a pulp mold for positioning and cushioning an article, and a molding means for manufacturing the pulp mold.

(II) Description of the Prior Art

Conventional packaging materials, such as those used to hold agricultural products or food, e.g., fruits, eggs. cans or fresh meat, or industrial products, e.g., computer parts, electronic components, electrical appliances and porcelain products, are usually made of polylone or EPE foam materials. As is well know, these materials are bulky, highly flammable and spontaneously combustible, un-degradable, toxical and non-recyclable, and thus cause significant problems to environmental protection. EPE foam material contains CFC which is known to be detrimental to the ozone of the atmosphere and is even worse to the earth's environment.

To overcome the disadvantages of the conventional packaging materials, most developed countries that have long engaged in environment protection waste no effort in finding substitutes and are increasingly using more and more pulp mold packaging materials. Since the raw material of pulp molds comes from recycled paper and is free from tree felling, the pulp molds are fully suitable in view of the growing environmental concerns. Compared to the conventional polylone and EPE foam materials, the pulp mold materials require less space and will not generate toxicant substances while burning. The fibrous contents of the pulp mold materials are capable of absorbing humidity. Furthermore, the pulp mold materials are not spontaneously combustible.

However, the existing pulp mold materials are designed to hold or support articles only. Specifically, they only function to position articles and provide no cushioning effect to the packaged articles. That is, the conventional pulp mold materials cannot minimize damages to the packaged articles due to collision or impact during shipping.

The inventor improves the design of the original application to provide better positioning and cushioning effects. According to the structure of the original application, the invention has corrugated surfaces to simulate the effect of spring for performing the best effect of the pulp mold. Previously, the conventional molding devices for making pulp molds could only be used for a specific design. When the article were no longer manufactured, the molding means could not be used. It was necessary to redesign a new molding means suitable for the new product.

SUMMARY OF THE INVENTION

One objective of the invention is to improve the cushioning effect of the original application.

A second objective of the invention is to provide a pulp mold comprising plurality of units. Each unit comprises plurality of higher and lower surfaces such that the pulp mold has a plurality of corrugated surfaces to provide a plurality of cushions.

Another objective of the invention is to provide a pulp mold that can adjust the number of units according to the weight and size of the article.

And a further objective of the invention is to provide the pulp mold molding unit means which can be constructed for suitable to the various articles. When the articles are no longer manufactured, the molding unit means can be re-constructed to be suitable for another product.

An objective of the invention is to provide a set of molding means comprising a plurality of molding unit means such that the number of the upper and lower molding unit means can be adjusted to produce various sizes of pulp mold suitable for various articles.

An objective of the invention is to provide a method for manufacturing the pulp mold. The existent molding unit means can be used to produce various sizes of pulp mold suitable for the various articles. It is not necessary to develop a new molding means.

BRIEF DESCRIPTION OF THE MAJOR PARTS

Figure 2:
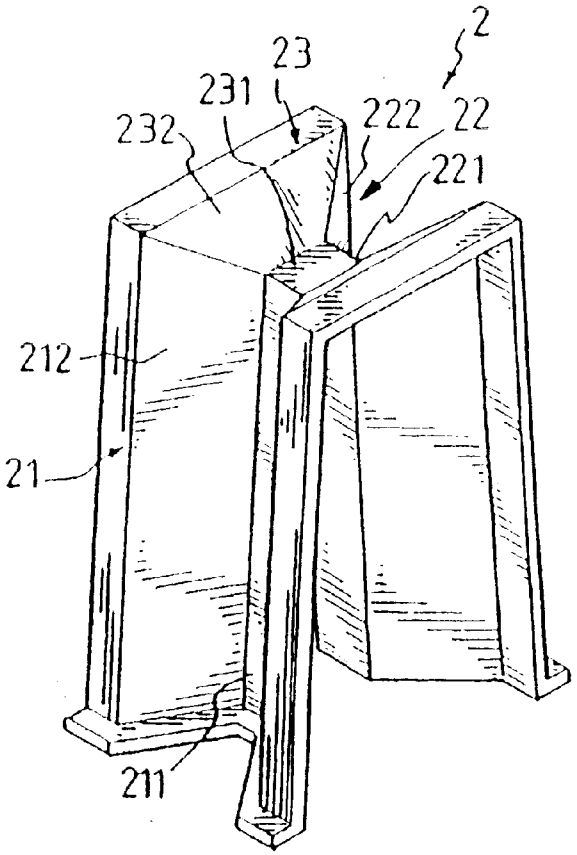
FIG. 2 is a perspective view of the other unit of the first embodiment according to the invention.

1 the unit of the first embodiment
11 the first surface
111 the central plane section
112 the oblique section
12 the second surface
122 the oblique section
13 the third surface
131 the central plane section
132 the oblique section
2 the other unit of the first embodiment
21 the first surface
211 the central plane section
212 the oblique section
22 the second surface
221 the central plane section
222 the oblique section
23 the third surface

231 the central plane section
232 the oblique section
3 pulp mold
31 the first corrugated surface
311 the first plane section
312 the first oblique section
313 the second plane section
314 the second oblique section
32 the second corrugated surface
321 the first plane section
322 the first oblique section
323 the second plane section
324 the second oblique section
33 the third corrugated surface
331 the first plane section
332 the first oblique section
333 the second plane section
334 the second oblique section
34 the corrugated bottom surface
341 the first plane section
342 the first oblique section
343 the second plane section
344 the second oblique section
4 pulp mold
41 the first corrugated surface
42 the second corrugated surface
43 the third corrugated surface
44 the corrugated bottom surface
5 the unit of the second embodiment
51 the first surface
52 the second surface
53 the third surface
54 the first oblique surface
541 central plane section
542 the oblique section
543 the oblique section
55 the second oblique surface
6 the other unit of the second embodiment
61 the first surface
62 the second surface
63 the third surface
64 the first oblique surface
65 the second oblique surface
7 pulp mold
71 the first corrugated surface
72 the second corrugated surface
73 the third corrugated surface
74 the first oblique corrugated surface
75 the second oblique corrugated surface
76 the corrugated bottom surface
8 pulp mold
81 the first corrugated surface
82 the second corrugated surface
83 the third corrugated surface
84 the first oblique corrugated surface
85 the second oblique corrugated surface
86 the corrugated bottom surface
9 pulp mold
914 the second plane section
924 the second plane section
934 the second plane section
944 the second plane section
954 the second plane section
964 the second plane section
10 pulp mold
15 article
16 package
1201 the bottom board
1202 the lower molding unit means
1203 the close net
1204 the upper molding unit means
1205 the upper board

DETAILED DESCRIPTION OF THE INVENTION

Figure 1:
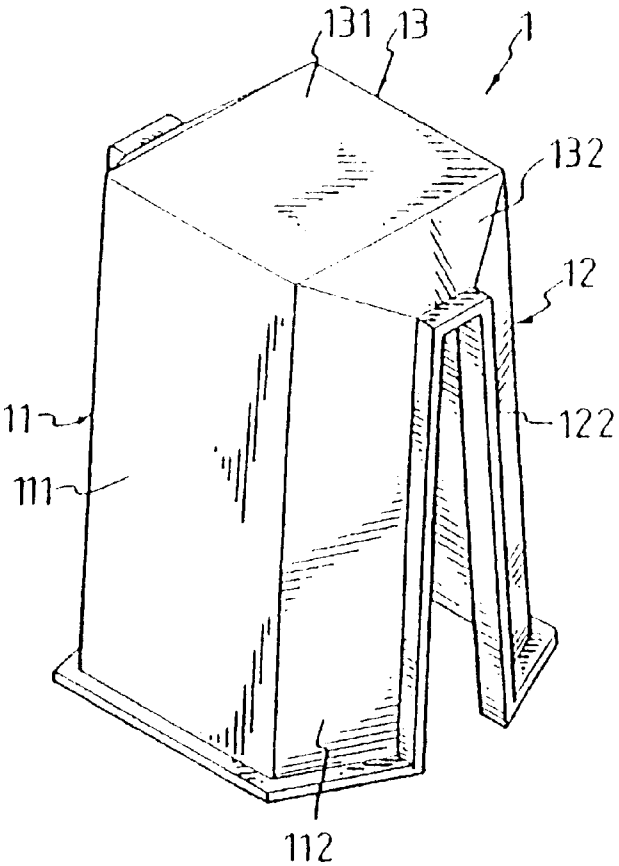
FIG. 1 is a perspective view of the unit of the first embodiment according to the invention.

According to the invention FIG. 1 shows unit 1 of the first embodiment. Unit 1 comprises three surfaces at (11), (12) and (13) generally in u-shape that is inverted in the orientation of FIG. 1. On each surface a central section is outward of the u-shape relative to two opposite side sections thereof. In FIG. 1, the first surface (11) is about parallel to the second surface (12). The third surface (13) is perpendicular to the first surface (11) and the second surface (12), and is placed and connected between the first and the second surface. The first surface (11) is comprised of a central plane section (111) and symmetrical oblique opposite-side sections (112), only one shown. The two opposite-side sections (112) are oblique towards the inside of the u-shape. As the first surface (11), the second surface (12) also comprises a central plane section (not shown, but symmetrical with the central plane section (111)) and symmetrical oblique opposite-side sections (122 only one shown and), the third surface (13) also comprises, a central plane section (131) and symmetrical oblique opposite-side sections (132). The central plane section (131) of the third surface (13) is connected to the central plane section (111) of the first surface (11) and the central plane section (121) of the second surface (12), the oblique section (132) of the third surface (13) is connected to the oblique section (112) of the first surface (11) and the oblique section (122) of the second surface (12). On each surface the central section is outward of the u-shape relative to the two side sections. Therefore, the invention also comprises the unit having the projecting surface which only has the two oblique sections without the central section and the unit having the circular central section. The unit is not limited to the unit as shown in FIG. 1.

According to the invention FIG. 2 shows unit 2 of the first embodiment. As unit 1, unit 2 also comprises three surface (21), (22) and (23). The difference between unit 1 and unit 2 is that the central section is lower than the two side sections on unit 2. The surface (21), (22) and (23) respectively is comprised of the central plane section (211), (221) and (231) and the symmetrical oblique sections (212), (222) and (232). The two sides of each surface are oblique sections (212), (222) and (232) are closer to the outside and higher than the central plane sections (211), (221) and (231). The central plane section (231) of the third surface (23) is connected to the central plane section (211) of the first surface (21) and the central plane section (221) of the second surface (22), the oblique section (232) of the third surface (23) is connected to the oblique section (212) of the first surface (21) and the oblique section (222) of the second surface (22). On each surface the central section is lower than the two side sections. Therefore, the invention also comprises a unit having a concave surface which only has two oblique sections without a central section and the unit having the circular central section. The unit is not limited to the unit as shown in FIG. 2.

Figure 3:
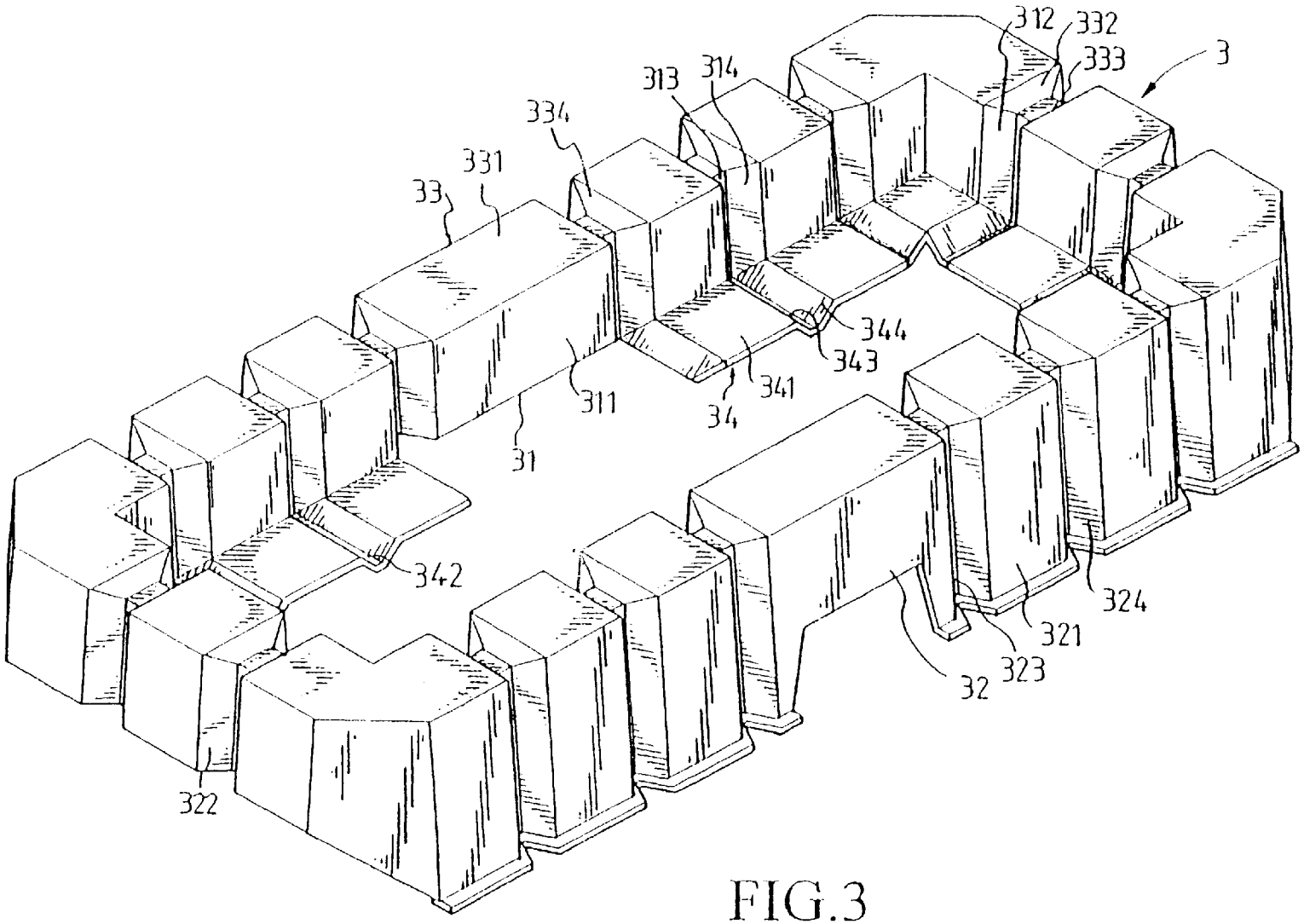
FIG. 3 is a perspective view of the first embodiment according to the invention.

FIG. 3 shows the first embodiment of the invention. Pulp mold 3 comprises unit 1 of FIG. 1 and unit 2 of FIG. 2 for positioning and cushioning of an article. Pulp mold 3 comprises three corrugated surfaces (31), (32) and (33) and a corrugated bottom surface (34), the first corrugated surface (31) is about parallel to the second corrugated surface (32), the third corrugated surface (33) is perpendicular to the first corrugated surface (31) and the second corrugated surface (32), and is placed and connected between the first and the second surface. The corrugated bottom surface (34) is connected to the other side of the first corrugated surface (31). The pulp mold is placed between the article and package. Three corrugated surfaces provide three times the cushioning. The first corrugated surface (31) contacts the surface of the article to provide the first cushion, the second corrugated surface (32) contacts the package to provide the second cushion and the third corrugated surface (33) is placed between article and package to provide the third cushion. The corrugated bottom surface (34) contacts the surface of the article to provide cushioning. The first corrugated surface (31) is comprised of the first plane section (311), the first oblique section (312), the second plane section (313) and the second oblique section (314). The second corrugated surface (32), the third corrugated surface (33) and the corrugated bottom surface (34) respectively comprise the first plane section (321), (331), (341), the first oblique section (322), (332), (342), the second plane section (323), (333), (343) and the second oblique section (324), (334), (344). Pulp mold 3 comprises a plurality of pulp mold units. Based on the weight of article, the pulp mold can adjust the number of pulp mold units and adjust the size of the plane section and the oblique sections so as to suit the various articles. When the article are no longer manufactured, the molding unit means can be re-constructed to be suitable for other products. The pulp mold of the invention is placed between the article and the package, the pulp mold can position an article and cushion an article.

Figure 4:
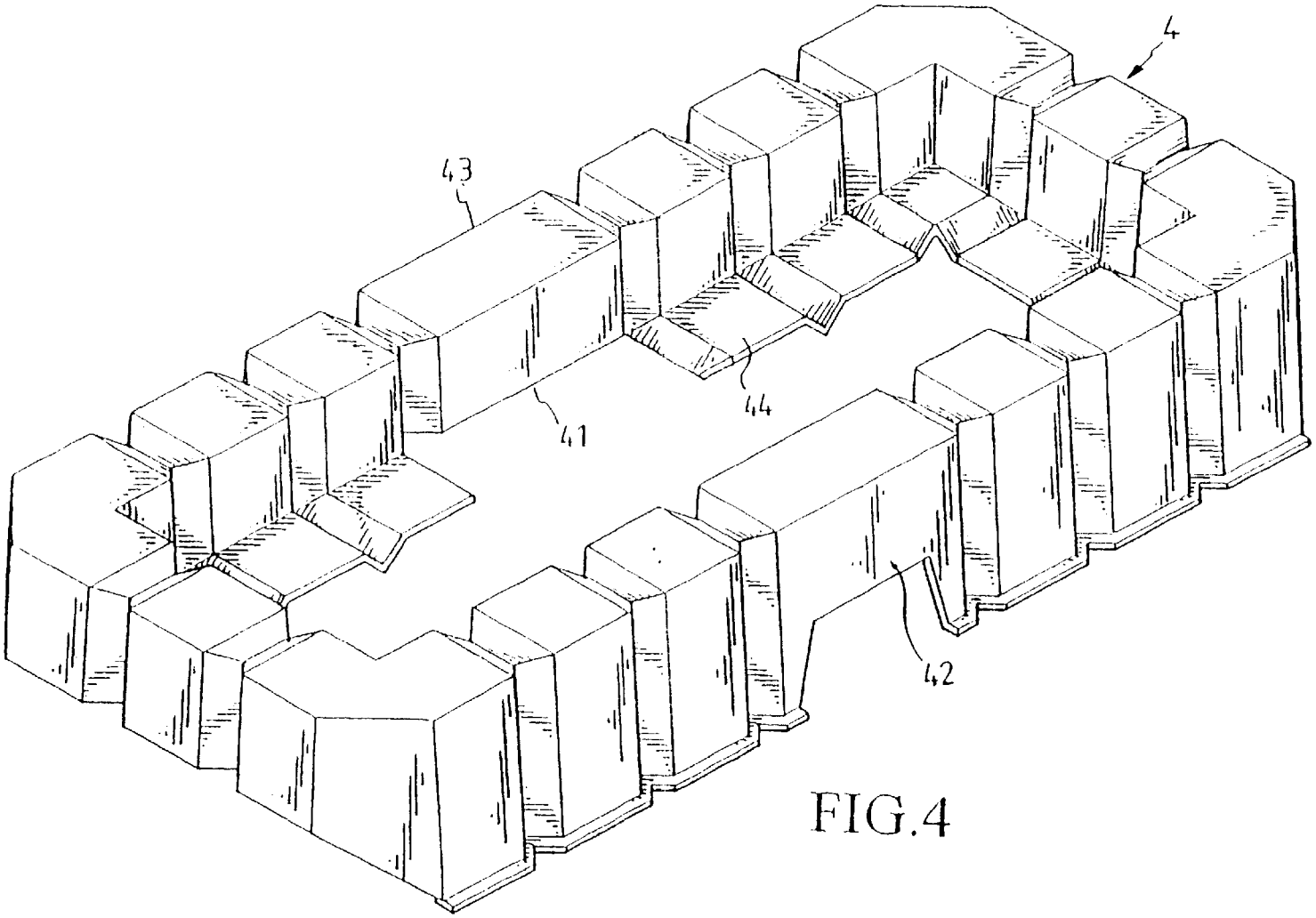
FIG. 4 is a perspective view of the other embodiment of FIG. 3 is according to the invention.

FIG. 4 is the another embodiment of the invention. The pulp mold 4 is only comprises unit 1 of FIG. 1. Pulp mold 4 still is comprised of three corrugated surfaces (41), (42), (43) and a corrugated bottom surface (44). The features of the pulp mold 4 are almost the same as that of pulp mold 3, the difference is that pulp mold 4 does not have the second plane section of pulp mold 3. The first oblique section is directly connected to the second oblique section. Pulp mold 4 does not have the second plane section, the saving of the space of the second plane section adds to the number of unit 1 and adds to the corrugated effects of the surfaces.

Figure 5:
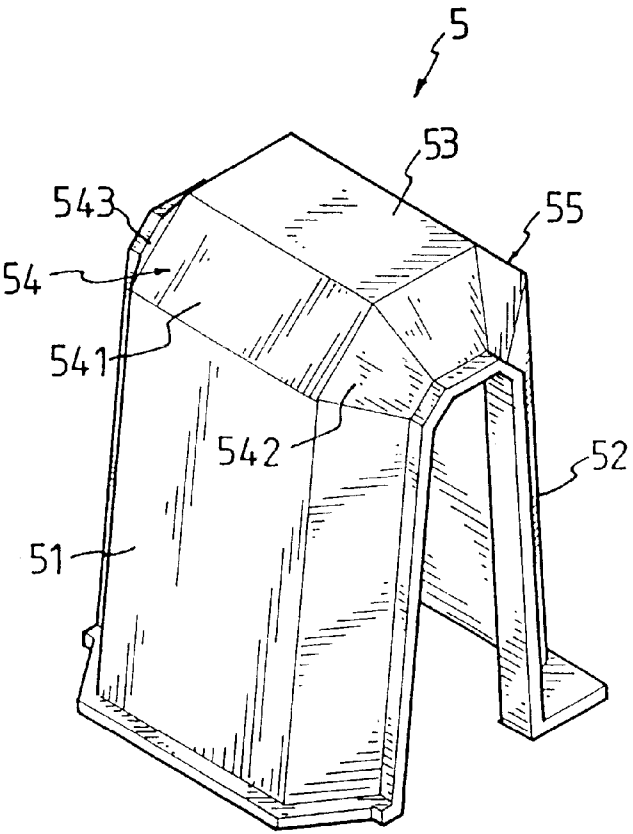
FIG. 5 is a perspective view of the unit of the second embodiment according to the invention.

FIG. 5 shows unit 5 of the second embodiment of the invention. In addition to three surfaces (51), (52) and (53), unit 5 comprises two oblique surface (54) and (55). The first oblique surface (54) is placed between the first surface (51) and the third surface (53) and is connected to the first and the third surface, the second oblique surface (55) is placed between the second surface (52) and the third surface (53) and is connected to the second and the third surface. The features of the surface of unit 5 is the same as the features of surface of unit 1. On each surface the central section is higher than the two side sections, and each surface is comprised of a central plane section and two side sections. The first oblique surface (54) is comprised of a central plane section (541), and oblique sections (542) and (543). As is the first oblique surface (54), the second oblique surface (55) is comprised of a central plane section and an oblique section. Unit 5 has two oblique surfaces so as to provide two times the cushioning effects.

Figure 6:
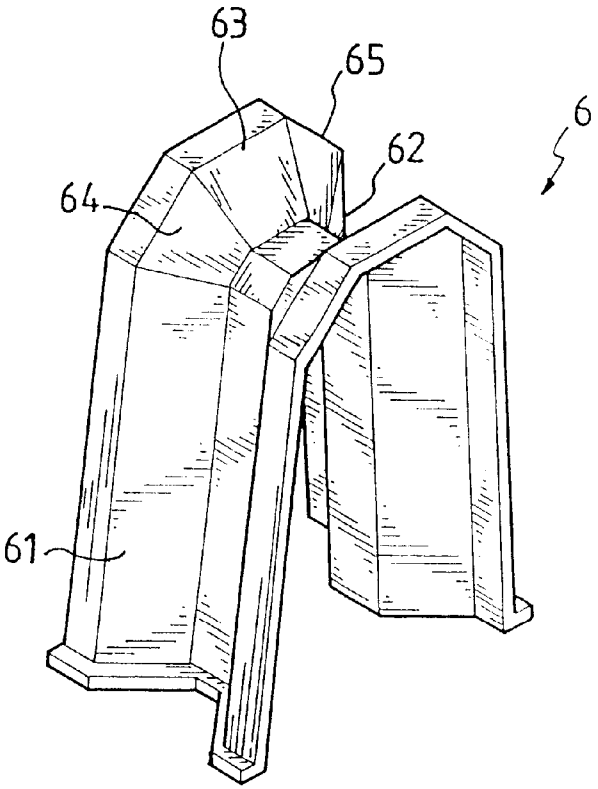
FIG. 6 is a perspective view of the other unit of the second embodiment according to the invention.
Figure 7:
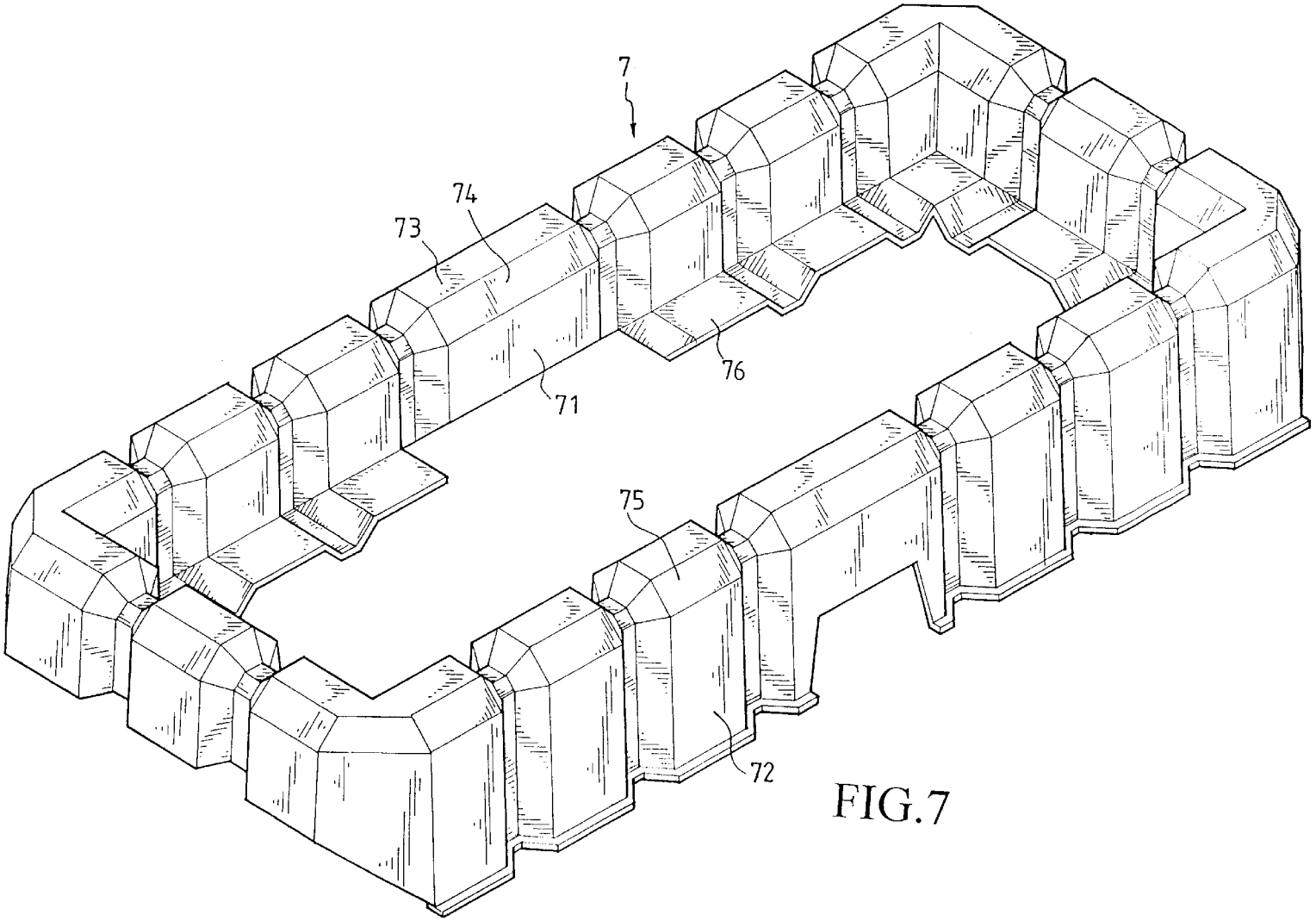
FIG. 7 is a perspective view of the second embodiment according to the invention.

FIG. 6 shows unit 6 of the other embodiment of the second embodiment of the invention. As unit 5, unit 6 is comprised of three surfaces (61), (62) and (63) and two oblique surfaces (64) and (65). The difference between unit 5 and unit 6 is that on each surface of unit 6 the central section is lower than the two side sections FIG. 7 is the second embodiment of the invention. Pulp mold 7 is comprised of unit 5 of FIG. 5 and unit 6 of FIG. 6 for positioning and cushioning an article. Pulp mold 7 is comprised of three corrugated surfaces (71), (72) and (73) and two oblique corrugated surfaces (74) and (75) and a corrugated bottom surface (76). The features of each corrugated surface of pulp mold 7 is the same as the features of each corrugated surface of pulp mold 3. The difference between pulp mold 7 and pulp mold 3 is that pulp mold 7 has oblique corrugated surfaces (74) and (75) to provide two times the cushioning effect. The addition of oblique corrugated surfaces (74) and (75) makes pulp mold 7 have the effect of deformation and spring recovery.

Figure 8:
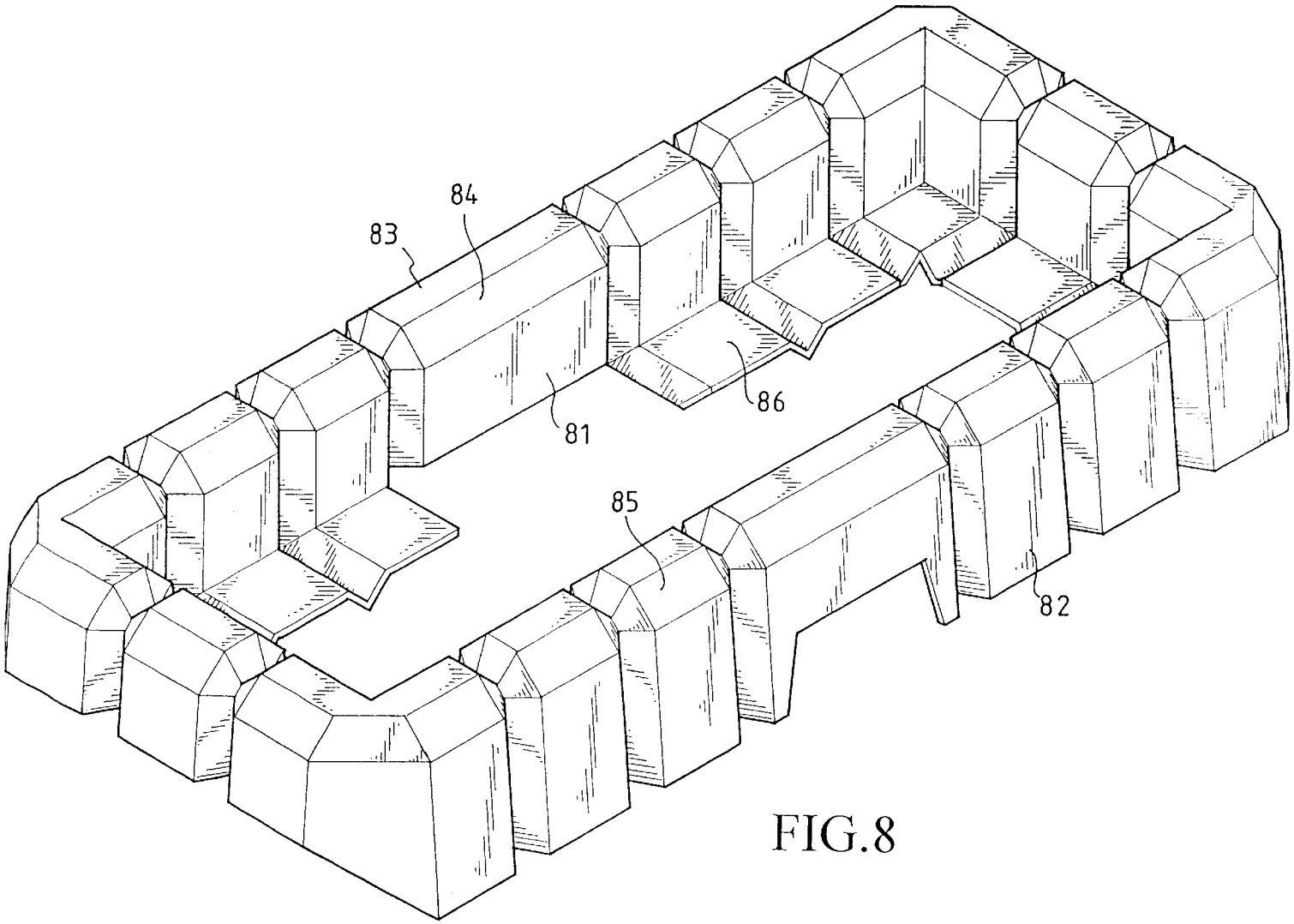
FIG. 8 is a perspective view of the other embodiment of FIG. 7 according to the invention.

FIG. 8 is the other embodiment of FIG. 7. Pulp mold 8 is comprised of a plurality of unit 5. Pulp mold 8 is comprised of three corrugated surfaces (81), (82), (83) and two oblique corrugated surfaces (84) and (85) and a corrugated bottom surface (86). The features of pulp mold 8 is almost the same as those of pulp mold 7. The difference is that pulp mold 8 does not have unit 6 so as to add to the number and add to the corrugated effect of the surface.

Figure 9:
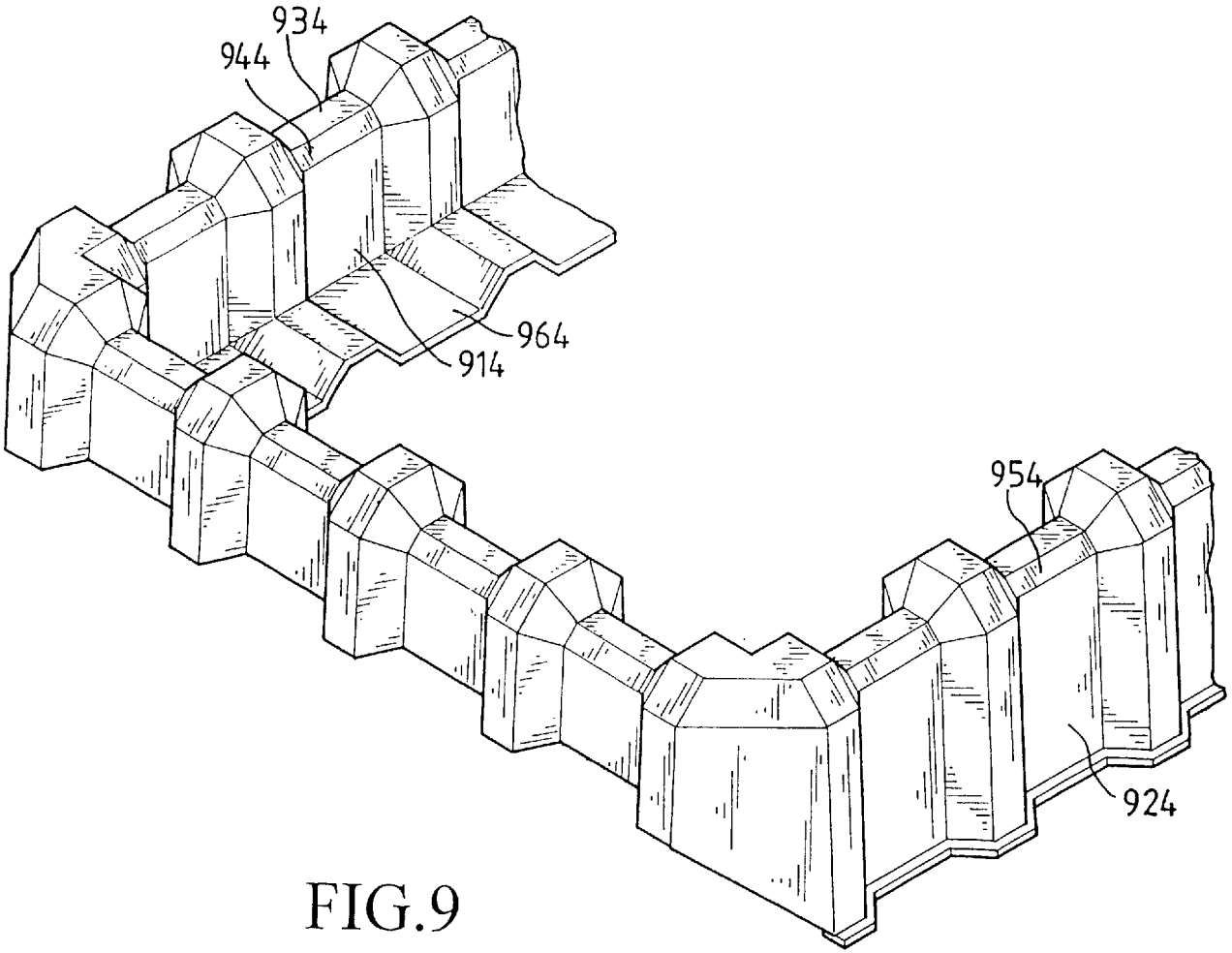
FIG. 9 is a perspective view of the other embodiment of FIG. 7 according to the invention.

FIG. 9 is the other embodiment based on FIG. 7 of the invention. In FIG. 9, the feature is that the second plane section (914), (924), (934), (944), (954), (964) of each corrugated surface is enlarged. The sections can contain the plane article so as to package the same article together to have a separating effect.

Figure 10:
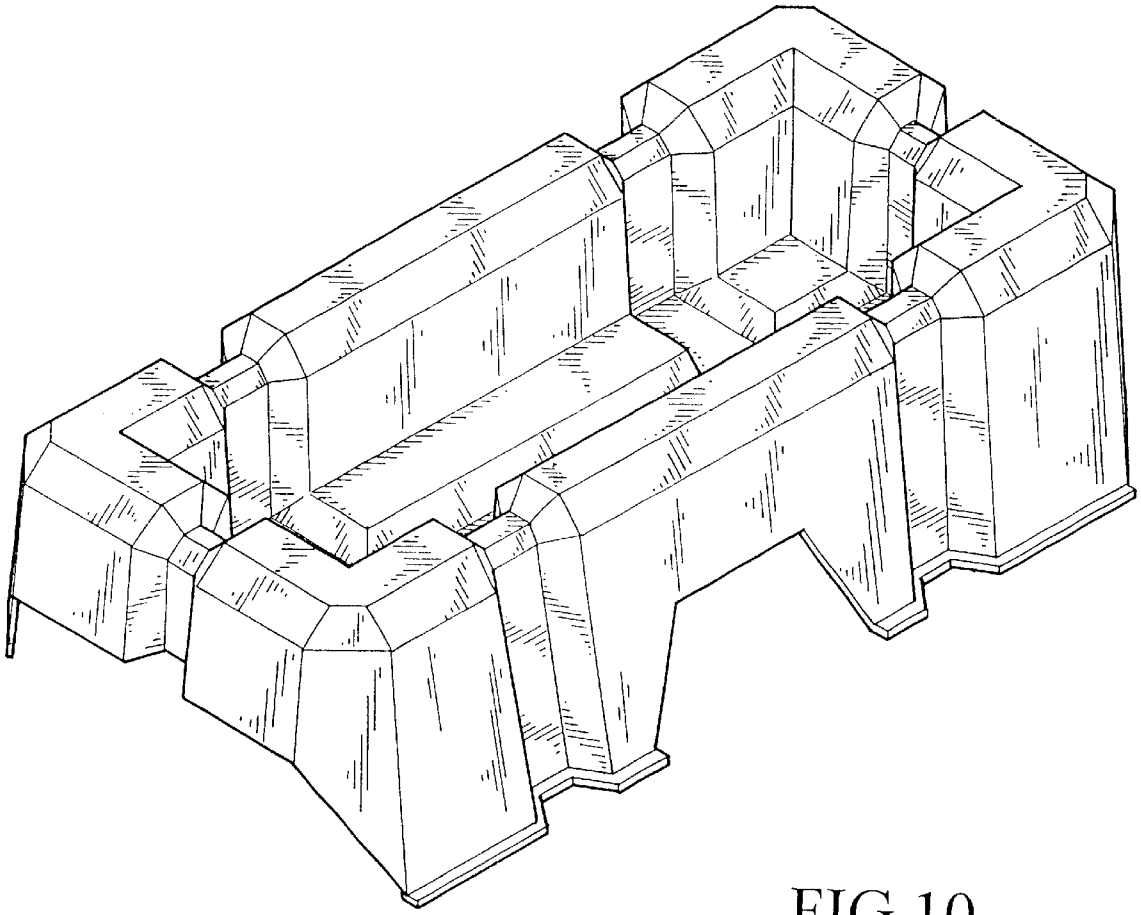
FIG. 10 is a perspective view of the other embodiment of FIG. 7 according to the invention.
Figure 11:
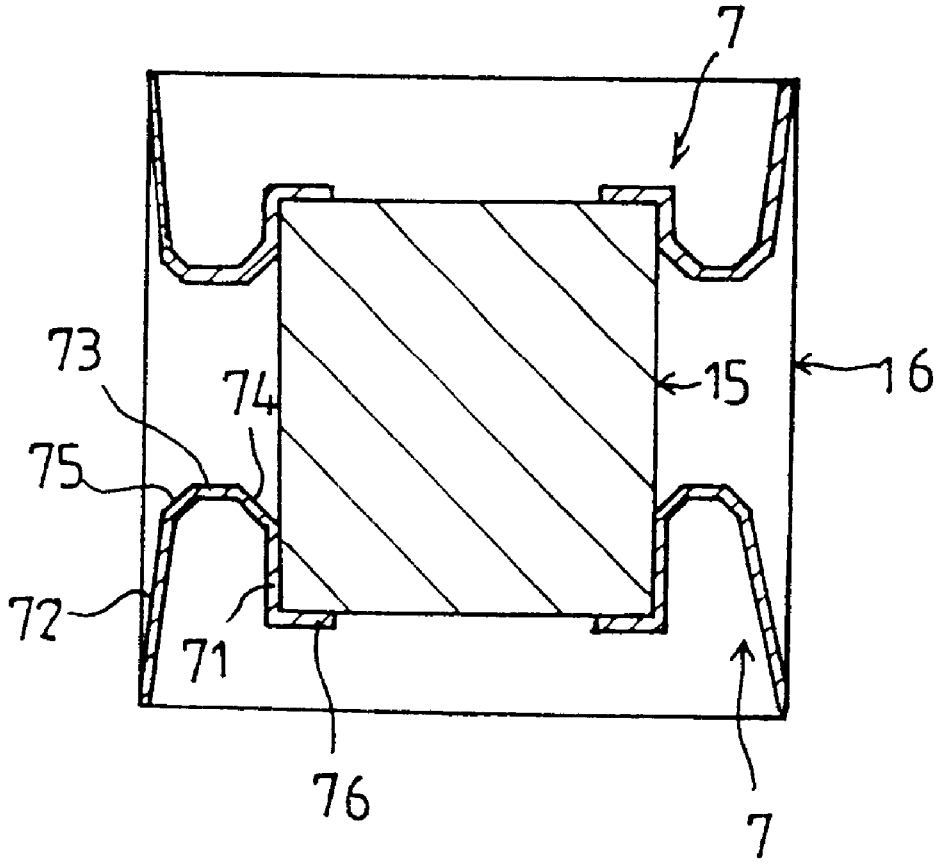
FIG. 11 is the cross-sectional view taken along line A—A in FIG. 7
Figure 12:
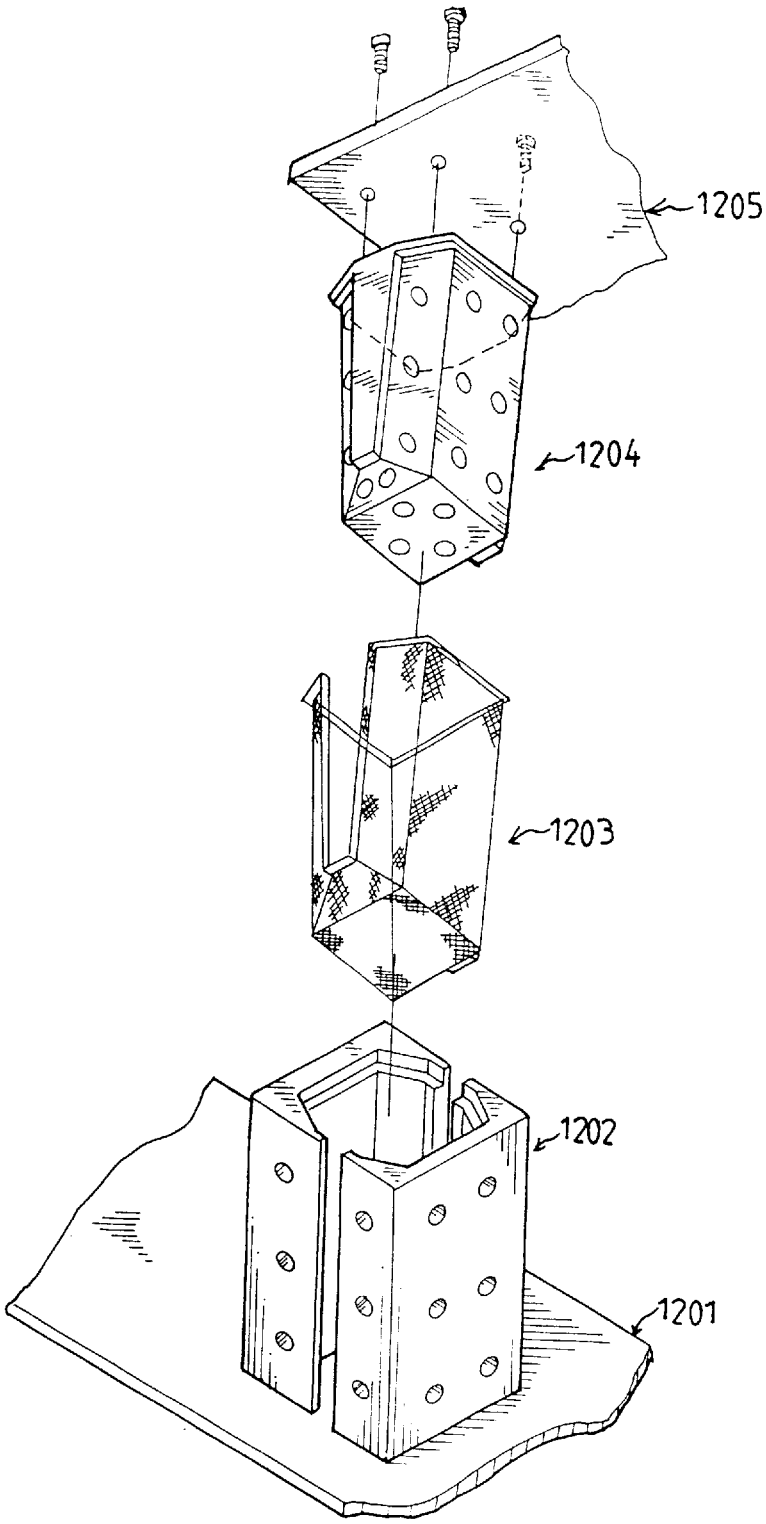
FIG. 12 is an exploded view of the molding unit means.
Figure 13:
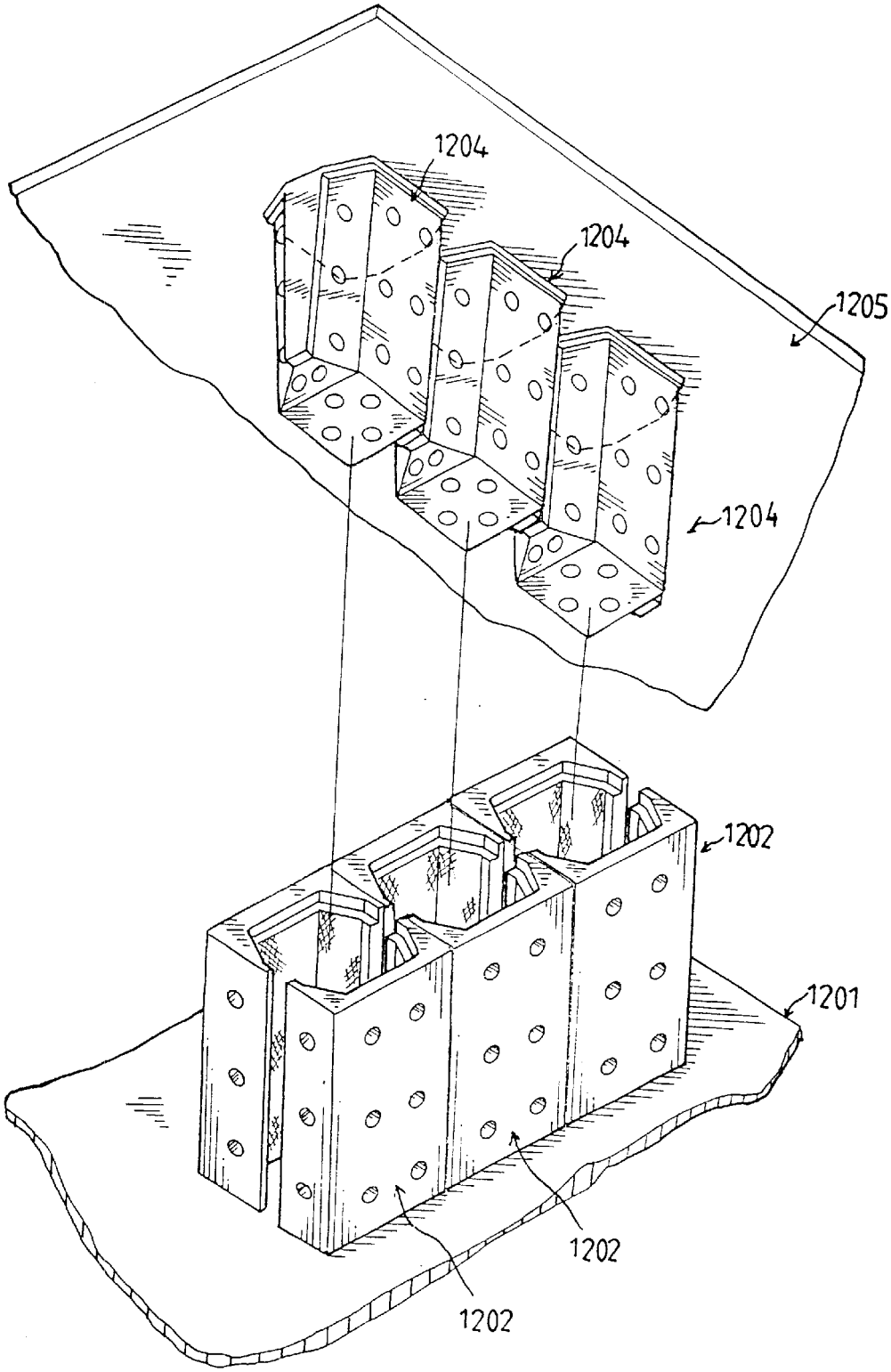
FIG. 13) illustrates the connection of the molding unit means.

FIG. 10 is the other embodiment of FIG. 7. The corrugated bottom surface is completely connected to the first corrugated surface completely and contacts the bottom of the article. Pulp mold 10 can package an article with a smaller bottom.

FIG. (11) shows the two pulp mold that package the article (15) and the relationship, between pulp mold 7 and article (15) and outer packaging (16). As shown in FIG. (11), the articles (15) are packaged with two pulp mold 7 so as to provide the cushioning for the article (15).

FIG. (12) is an exploded view of the molding unit means. The molding unit means is comprised of a bottom board (1201), a lower molding unit means (1202), a close net (1203), an upper molding unit means (1204) and an upper board (1205). The lower molding unit means (1202) are fixed on the bottom board (1201). The lower molding unit means (1202) and the bottom board (1201) have holes for draining water from the pulp mold. Based on the shape of the lower molding unit means (1202), and the close net (1203) are covered on the inside of the lower molding unit means (1202). When the pulp is irrigated into the lower molding unit means (1202), the pulp attaches to the close net (1203) and water from the pulp drains from the holes in the lower molding unit means (1202) and the bottom board (1201). The upper molding unit means (1202) are fixed on the upper board (1205). The holes in the lower molding unit means (1202) are connected to the compressor and air is blown to make the pulp mold separate from the lower molding unit means (1202). The upper molding unit means (1204) also have holes for sucking water from the pulp mold allowing the pulp mold to dry.

FIG. (13) shows the connection of the molding unit means. Based on the size of the article, the lower molding unit means (1202) and the upper molding unit means (1204) are constructed on the bottom board (1201) and the upper board (1205) respectively, so as to adjust the number of the lower and upper molding unit means for constructing suitable lower and upper sets of molding unit means. Based on the shape of the lower set of molding unit means, the close net are covered on the inside of the lower set of molding unit means. The pulp is irrigated into the lower set of molding unit means. The pulp attaches on the close net, and from the hole of the lower set of molding unit means and the bottom board (1201) water from the pulp flows out. The upper set of molding unit means are compressed down for forming a suitable thickness of pulp mold, then the air is blown from the hole of the lower set of molding unit means to make the pulp mold separate from the lower set of molding unit means and the pulp mold is sucked to the upper set of molding unit means from the hole in the upper set of the molding unit means to dry the pulp mold on the dryer. Based on the above method, the various pulp molds can be manufactured to suit various articles.

What is claimed is:

1. In a mold unit for constructing a pulp mold for positioning and cushioning an article, the improvements comprising:

first, second and third surfaces in a general u-shape, each of the surfaces having a central and opposite-side sections, the central section of each of the surfaces being outward of the general u-shape relative to the opposite-side sections thereof, wherein the central section of the first surface is about parallel to the central section of the second surface, and the central section of the third surface is perpendicular to the central sections of the first and second surfaces and placed and connected between the first and the second surfaces for the general u-shape.

2. The pulp mold unit as claimed in claim 1, wherein the central section of each of the surfaces is plane and the two opposite-side sections thereof are positioned at an oblique angle relative to the central section toward the inside of the general u-shape.

3. The pulp mold unit as claimed in claim 2, and further comprising first and second further surfaces each having a central section outward of the general u-shape relative to two opposite-side sections thereof, wherein the central section of each of the further surfaces is plane and the two opposite-side sections thereof are positioned at an oblique angle relative to the central section toward the inside of the general u-shape, and wherein the first further surface is placed between and connected to the first and third surfaces, and the second further surface is placed between the second and third surfaces.

4. In a pulp mold unit for constructing a pulp mold for positioning and cushioning an article, the improvements comprising:

first, second and third surfaces in a general u-shape, each of the surfaces having a central and opposite-side sections, the central section of each of the surfaces being inward of the general u-shape relative to the opposite-side sections thereof, wherein the central sections of the first surface is about parallel to the central section of the second surface, and the central section third surface is perpendicular to the central sections of the first and second surfaces and placed and connected between the first and the second surfaces for the general u-shape.

5. The pulp mold unit as claimed in claim 4, wherein the central section of each of the surfaces is a plane and the two opposite-side sections thereof are positioned at an oblique angle relative to the central section toward the outside of the general u-shape.

6. The pulp mold unit as claimed in claim 5, and further comprising first and second further surfaces each having a central section inward of the general u-shape relative to two opposite-side sections thereof, wherein the central section of each of the further surfaces is plane and the two opposite-side sections thereof are positioned at an oblique angle relative to the central section toward the outside of the general u-shape, and wherein the first further surface is placed between and connected to the first and third surfaces, and the second further surface is placed between and connected to the second and third surfaces.

* * * * *

UNITED STATES PATENT AND TRADEMARK OFFICE

CERTIFICATE OF CORRECTION

PATENT NO. : 6,361,659 B1
DATED : March 26, 2002
INVENTOR(S) : Chun-Tse Yang

It is certified that error appears in the above-identified patent and that said Letters Patent is hereby corrected as shown below:

Title page,
Item [30], "CN" should read -- TW -- and after "A" insert -- 01 --.

Signed and Sealed this

Eighteenth Day of March, 2003

JAMES E. ROGAN
*Director of the United States Patent and Trademark Office*